US008376694B1

(12) United States Patent
Beal et al.

(10) Patent No.: US 8,376,694 B1
(45) Date of Patent: Feb. 19, 2013

(54) SYSTEMS AND METHODS TO GENERATE PROPULSOR SIDE FORCES

(75) Inventors: David N. Beal, Providence, RI (US); Stephen A. Huyer, Saunderstown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 714 days.

(21) Appl. No.: 12/651,559

(22) Filed: Jan. 4, 2010

Related U.S. Application Data

(60) Provisional application No. 61/202,589, filed on Mar. 13, 2009.

(51) Int. Cl.
*B63H 5/04* (2006.01)

(52) U.S. Cl. ..... 415/160; 415/191; 415/208.2

(58) Field of Classification Search ..... 415/191, 415/159, 160, 208.2; 440/66, 67
See application file for complete search history.

(56) References Cited

U.S. PATENT DOCUMENTS 2,795,201 A * 6/1957 Fogarty et al. ..... 114/23
3,056,374 A * 10/1962 Linhardt ..... 114/151
3,442,244 A * 5/1969 Corlett et al. ..... 114/163
4,694,645 A * 9/1987 Flyborg et al. ..... 60/221

* cited by examiner

*Primary Examiner* — Ninh H Nguyen
(74) *Attorney, Agent, or Firm* — James M. Kasischke; Michael P. Stanley; Jean-Paul A. Nasser

(57) ABSTRACT

Systems and methods for maneuvering an underwater vehicle by generating vehicle maneuvering forces from a propulsor of the vehicle are provided. A ducted, pre-swirl propulsor is configured such that the pitch angles of the stator blades of the upstream stator row can be varied. By varying the pitch angles of the stator blades about the circumference, a mean stator side force is generated. Subsequently, the axial velocity and swirl that is ingested into the inflow is varied. The rotor of the propulsor then generates a side force in response to the inflow.

19 Claims, 9 Drawing Sheets

SYSTEMS AND METHODS TO GENERATE PROPULSOR SIDE FORCES

CROSS REFERENCE TO OTHER PATENT APPLICATIONS

This application claims the benefit of U.S. Provisional Patent Application No. 61/202,589 filed on Mar. 13, 2009 and entitled "A Method to Generate Propulsor Side Forces" by the inventors, David N. Beal and Stephen A. Huyer.

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates to maneuvering an underwater vehicle, and more specifically to systems and methods for generating vehicle maneuvering forces from a propulsor.

(2) Description of the Prior Art

Standard torpedoes and Unmanned Undersea Vehicles (UUVs) utilize a single propulsor at the stern coupled with control surfaces to provide the vehicle with necessary forces and moments to offer control. At higher speeds, this combination generally is satisfactory in terms of offering sufficient control. At low speeds, control surface effectiveness is significantly diminished, with the extreme condition being zero forward velocity (e.g., Bollard condition). There are several operations where low speed control is vitally important for UUV mission requirements. These include UUV recovery, station-keeping and synthetic aperture sonar.

Side forces have been generated using thrust vectoring. In this case, the thrust is re-directed off-axis to generate side forces for control. To meet low speed requirements, autonomous research vehicles have utilized tunnel thrusters to offer lateral and vertical control.

The difficulty is that this method is most effective at zero speeds. As the flow velocity is increased, tunnel thruster effectiveness is significantly diminished. It has been shown that tunnel thrusters are only twenty percent effective above five knots. The tunnel thrusters also increase parasitic drag so that maximum velocities are reduced. In addition, tunnel thrusters take up considerable volume that could otherwise be used for energy or payload.

Another concept is referred to as the Haselton bow propulsor, first introduced in the 1960's. In this concept, a pair of propellers, one at the bow and one at the stern, is used in tandem to provide vehicle control. Side forces are generated via cyclic pitch actuation similar to that used for helicopter rotors.

The design utilizes a swash plate so that angle of attack is varied during a single propeller rotation. For example, if maximum and minimum angles of attack are reached at 0° and 180°, the higher thrust force at 0° and lower thrust force at 180° will generate a moment couple. By adding rake and skew to the propeller, it is then possible to generate a substantial side force component.

The disadvantage is that the Haselton bow propulsor concept remains mechanically complex for implementation on undersea vehicles. In addition, placing a propulsor at the bow of the vehicle interferes with forward looking sonar systems.

What are therefore needed are systems and methods for maneuvering an underwater vehicle that are effective at reasonable operating speeds; that do not significantly reduce maximum velocities; and that do not take up considerable volume. Additionally, the systems and methods should be relatively simple to implement without interfering with forward looking sonar.

SUMMARY OF THE INVENTION

It is therefore a general purpose and object of the present invention to provide systems and methods for maneuvering an underwater vehicle by generating vehicle maneuvering forces from a propulsor of the vehicle.

To attain this object, the present invention is configured for a ducted, pre-swirl propulsor such that the pitch angles of the stator blades of the upstream stator row can be varied. By varying the pitch angles of the stator blades about the circumference, it is possible to both generate a mean stator side force and subsequently vary the axial velocity and swirl that is ingested into the inflow. The rotor of the underwater vehicle then generates a side force in response to the inflow.

In one embodiment, a method is provided for designing a ducted, pre-swirl propulsor for an underwater vehicle in order to produce maneuvering forces includes characterizing a stator-induced flow for a variation in stator blade pitch angles. The method also includes computing rotor forces based on the induced flow and choosing rotor blade parameters to optimize the rotor forces. The rotor forces in combination with flow-induced stator forces produce enhanced maneuvering forces.

In one embodiment, characterizing the induced flow includes varying the stator blade pitch angles symmetrically about the circumference of the underwater vehicle. Varying can include sinusoidally varying the pitch angles dependent on the angular position of the stator blades about the circumference.

Further, characterizing the flow can include recursively characterizing a plurality of flows based on incrementing the number of stator blades, incremental changes in the variation in stator blade pitch angles, or a combination of both. The method can further include selecting one or more of the flows as the induced flow for computing the rotor forces.

In one embodiment, computing the rotor forces includes recursively computing a plurality of forces based on incrementing the number of rotor blades, incremental changes in rotor blade skew, incremental changes in rotor blade rake, or a combination of two or more of these. Further, the plurality of forces can be recursively computed based on the plurality of flows.

Still further, choosing rotor blade parameters can include selecting a combination of two or more of the number of rotor blades, the rotor blade skew and the rotor blade rake. In one embodiment, the choosing step is based on maximizing the mean rotor forces and minimizing the unsteady rotor forces.

In one embodiment, a ducted pre-swirl propulsor system is provided. The propulsor system includes a row of stator blades whose pitch angles, $\alpha_{blade}$, vary about the circumference of the vehicle so as to produce a circumferentially-varying downflow. The rotor ingests the downflow and produces a side force on the vehicle.

In one embodiment, the pitch angle varies symmetrically about the circumference. The pitch angle can vary according to a sinusoidal function, which can take the form $\alpha_{blade}=\alpha_{mean}+A \sin \theta$, where $\alpha_{mean}$ is the mean angle of attack of the stator blades; A is a pitch amplitude parameter;

and θ is the angular position of the stator blades about the circumference. In one embodiment, the mean angle of attack is 0°.

In one embodiment, the stator blades have a symmetrical blade cross section. And in one embodiment, the row of stator blades has an even number of blades and the rotor has an odd number of blades.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DETAILED DESCRIPTION OF THE PREFERRED INVENTION

Figure 1:
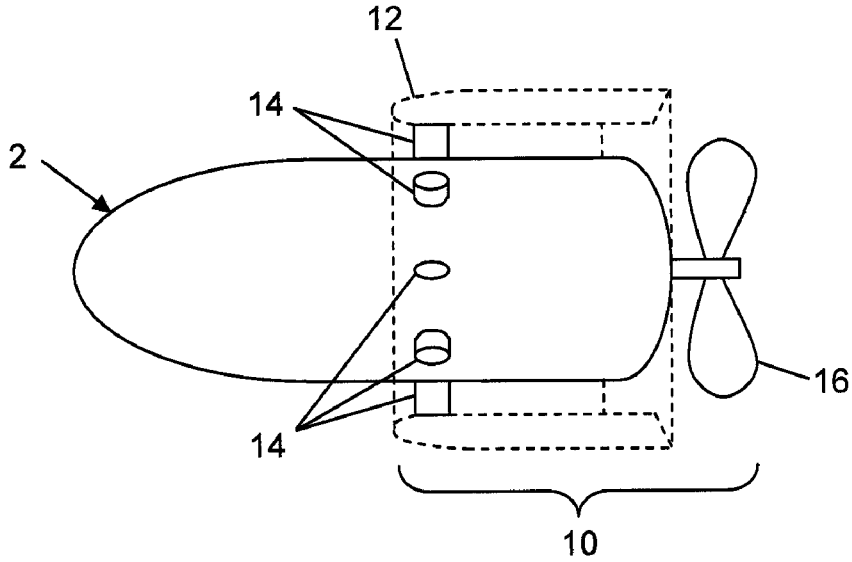
FIG. 1 shows a side view of a ducted pre-swirl propulsor of the present invention.
Figure 2A:
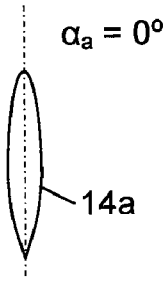
FIGS. 2A-2H show top views of the stator blades of the propulsor of FIG. 1.
Figure 2B:
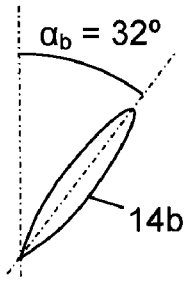
Figure 2C:
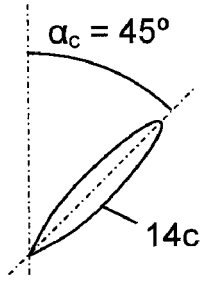
Figure 2D:
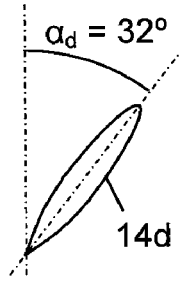
Figure 2E:
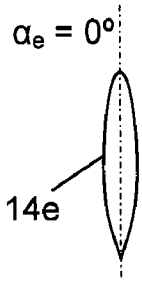
Figure 2F:
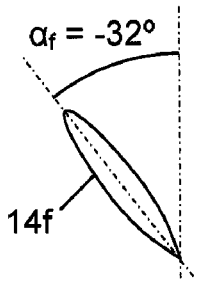
Figure 2G:
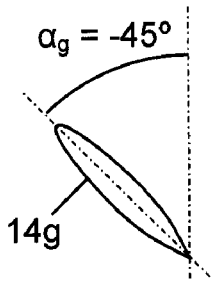
Figure 2H:
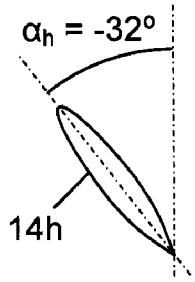

Referring to FIG. 1, there is shown a side view of an underwater vehicle 2 in which the vehicle has a ducted pre-swirl propulsor 10. For clarity of illustration, duct 12 of the propulsor 10 is shown in phantom. During normal operation and in prior art designs, upstream stator blades 14 are situated at the same pitch angle, or angle of attack, and pre-swirl a flow towards rotor 16 of the propulsor 10. As is known to those of skill in the art, pre-swirling the flow results in generating a roll moment which counters the moment produced by rotor 16.

For the propulsor 10 to generate vehicle maneuvering forces, the upstream stator blades 14 are situated at varying pitch angles. As will be explained in further detail hereinafter, calculations indicate that this variation in pitch angle results in the upstream stator blades 14 generating a stator side force. Further, the variation in pitch angle also introduces a circumferentially varying downwash that is ingested into the rotor 16. In response, the rotor 16 produces a rotor side force whose magnitude and direction is dependent on the blade number and on the rake and skew parameters of the rotor.

The stator side force and downwash are dependent on the number of the stator blades 14 and the pitch angle variation. Referring now to FIGS. 2A-2H, there are shown respective top views of stator blades 14*a*-14*h*, indicating exemplary pitch angles $\alpha_a$-$\alpha_h$. For illustrative purposes, but not limitation, eight stator blades 14 are shown in FIGS. 2A-2H.

The pitch angles are varied symmetrically about the circumference to better smooth the circumferential velocity variation of the downwash. For illustrative purposes, but not limitation, an exemplary sinusoidal variation is shown in FIG. 2. Mathematically, the exemplary angles of attack for each blade, $\alpha_{blade}$, can be expressed as $$\alpha_{blade}=\alpha_{mean}+A \sin \theta; \text{ where:} \quad (1)$$

$\alpha_{mean}$ is the mean angle of attack of the stator blades;

A is the pitch amplitude parameter; and

θ is the angular position of the stator blade about the circumference.

For the exemplary eight blades shown in FIG. 2, values for $\alpha_{mean}$ and A are arbitrarily taken to be 0.0 and 45, respectively. For each successive blade, θ is incremented by 45° (360°/8) to obtain the angles of attack shown in FIGS. 2A-2H.

As described above, the stator side force and downwash are dependent on the number of stator blades and their pitch angles. Further, the rotor side force is dependent on the downwash characteristics and the rotor geometry. The following provides a methodology for designing a propulsor that generates vehicle maneuvering forces.

Figure 3:
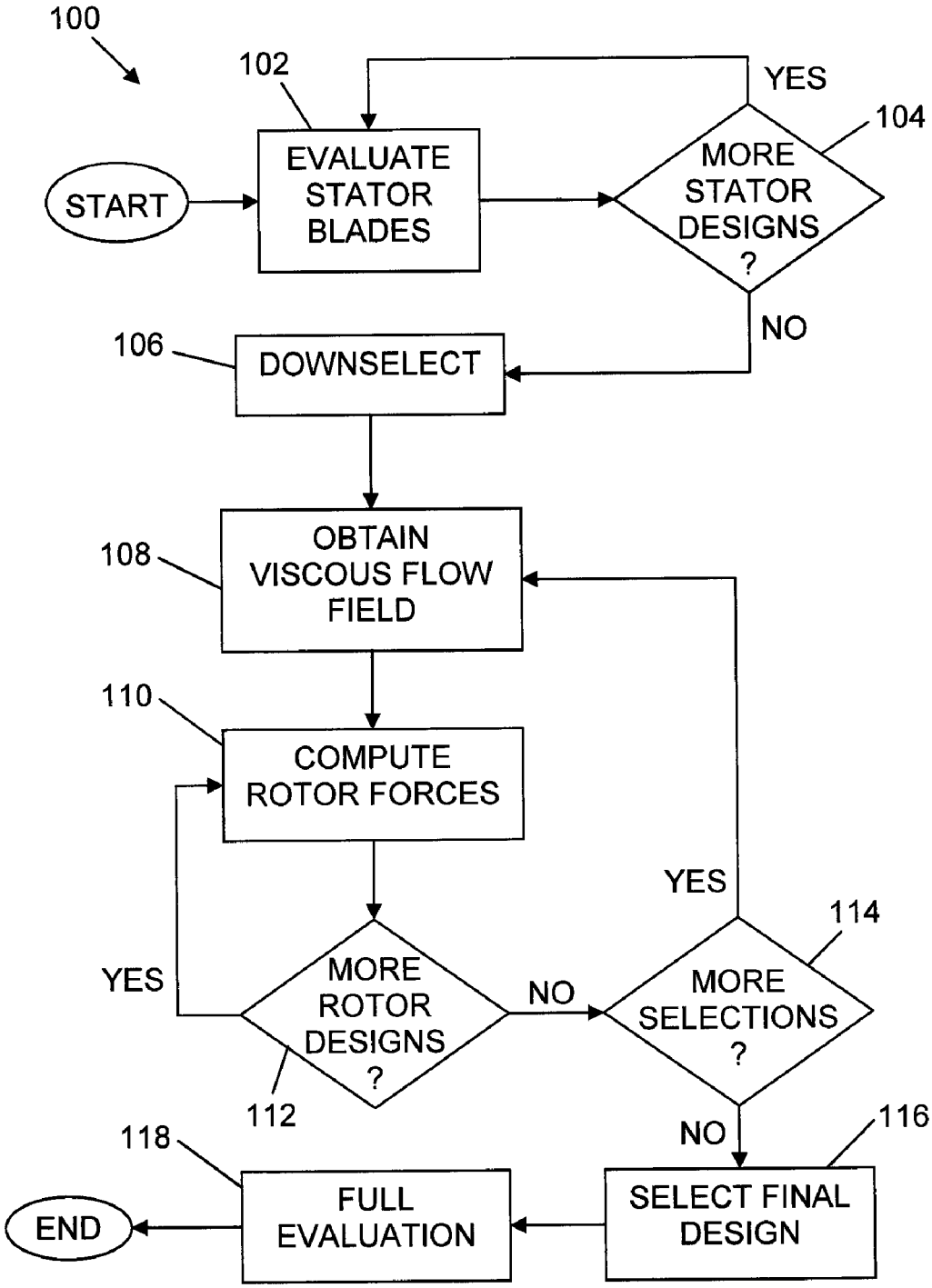
FIG. 3 shows a block diagram of a method for propulsor design.

Referring now to FIG. 3, there is shown a block diagram of method 100 for propulsor design. To start, initial stator blade designs (i.e., the number of stator blades and pitch angle variance) are evaluated (block 102). On a more fundamental level, the evaluations at block 102 can include stator blade parameters such as rake, skew, tip and root radius, chord length and thickness. Once all applicable designs are evaluated, as determined at block 104, final designs are downselected (block 106) based on estimates of induced velocities and stator forces obtained from the evaluations at block 102.

Each downselected design is evaluated (block 108) to obtain the corresponding three-dimensional viscous flow field. The viscous flow field is used to provide velocity boundary conditions for a downstream rotor. Using the computed flow field, the steady and unsteady induced rotor forces are computed at block 110 for a variety of rotor design parameters (blade number, rake and skew). Once the range of rotor parameters are evaluated for a particular downselected design, as determined at 112, and all downselected designs have been so evaluated, as determined at block 114, a final design is selected (block 116) to maximize the rotor side forces. The final design is then fully evaluated (block 118) to end the method 100.

The evaluations at blocks 102, 108, 110 and 118 can be performed using techniques known to those skilled in the art. As examples and for purposes of discussion, but not limitation, known potential flow methods are used to provide the estimates at block 102 and the induced rotor forces at block 110. To obtain the three-dimensional viscous flow fields at block 108 and the full evaluation at block 118, a known Reynolds Averaged Navier-Stokes (RANS) modeling technique is used.

The following calculations are provided as an example of the use of method 100 in designing a propulsor that generates vehicle maneuvering forces. The parameters chosen in this example are for exemplary purposes only and are not to be construed as limiting the use of method 100. For clarity of discussion, but not limitation, non-dimensional quantities are used, with length and velocity scales relative to the maximum blade radius and free-stream velocity, respectively.

A relatively simple symmetrical stator blade with zero rake and skew distribution and constant chord is chosen for this example. A symmetrical stator blade section is chosen due to the use of positive and negative pitch angles. The stator blades have a maximum radius of 1.0 at the tip and minimum radius of 0.5 at the root and a chord length of 0.5. Standard blade design practices also place the maximum thickness at the mid-chord point.

In addition, parameters governing the shape of the vehicle body and duct are chosen in order to bound the evaluations to the number of stator blades, pitch variance and rotor design. These parameters include sufficient duct area to generate propulsion. For this example, the maximum body diameter is 0.5 (non-dimensionalized by the propeller radius, $R_{prop}$) and the inner duct diameter is 1.0. The body has a spherical leading edge and an ellipsoidal afterbody sufficient to eliminate flow separation. Similarly, the duct is thin with a spherical leading edge and ellipsoidal trailing edge. The afterbody convergence angle (which decreases with an increased ratio of the major to minor axis) determines whether or not flow separation occurs. Computational Fluid Dynamics (CFD) analysis codes can be used to ensure that flow separation is eliminated.

The inner portion of the duct is located at a radius of 1.0 and has a non-dimensional thickness of 0.1. A spherical leading edge and ellipsoid trailing edge sufficiently long to eliminate separation is incorporated. As the duct is assumed to be thin, issues regarding flow separation are not as critical compared with the afterbody shape. The stator blade row is also placed two body radii downstream of the nose so that effects due to flow acceleration around the nose are minimal. The duct area is sufficiently long to accommodate both the stator row as well as the downstream rotor, with a total length of 2.5 (normalized by the blade radius). The stator blade row leading edge is located 0.6 blade radii downstream of the duct leading edge.

The previouslydiscussed sinusoidal pitch angle variation scheme is used, with a mean swirl velocity of 0.0 as the design point. Consequently, the mean angle of attack of the stator blades is 0.0 with a variation in angle of attack about the circumference determined by the pitch amplitude parameter, A, in Equation (1).

Figure 4A:
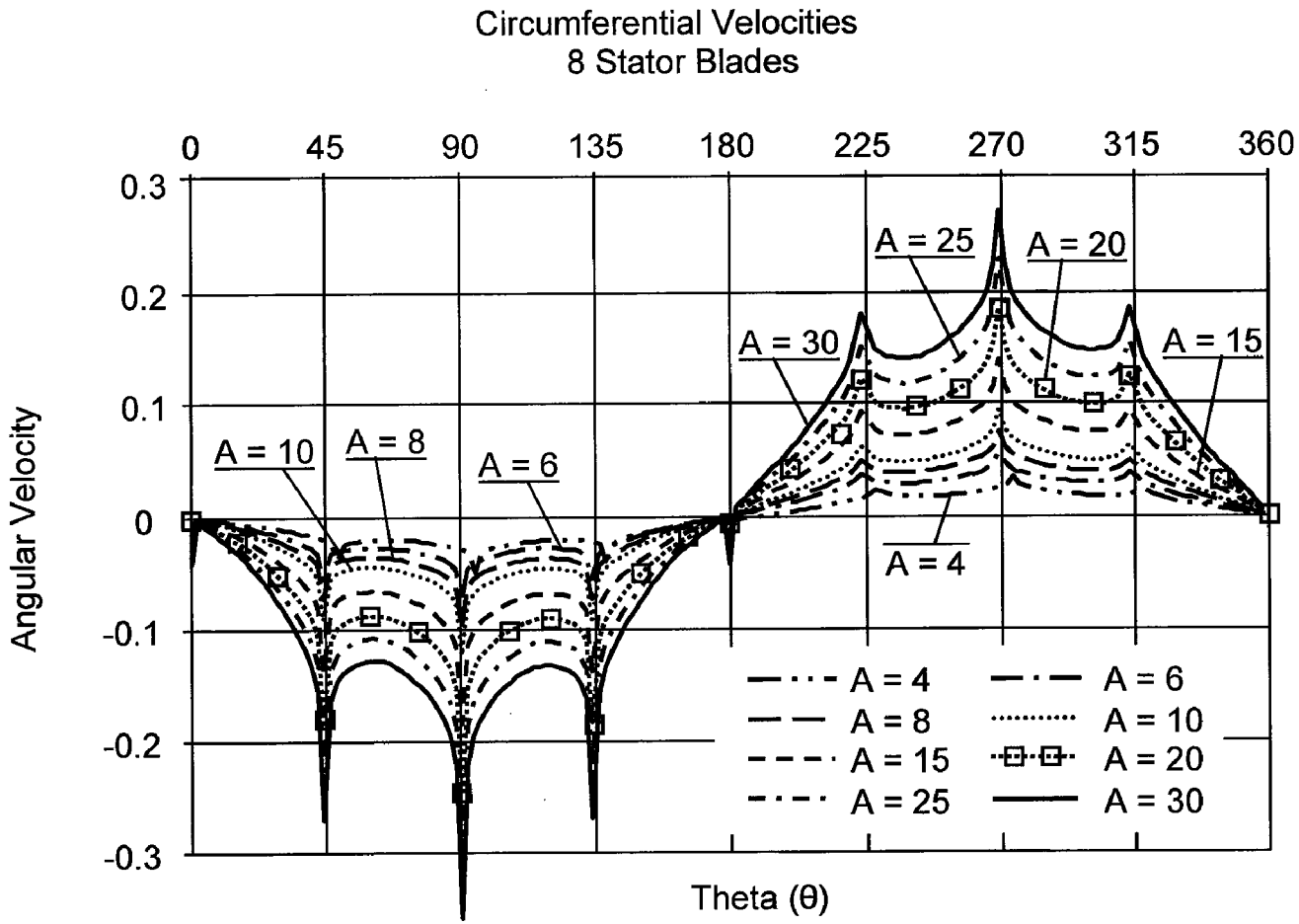
FIGS. 4A and 4B are circumferential velocity plots for eight and twelve stator blades, respectively.
Figure 4B:
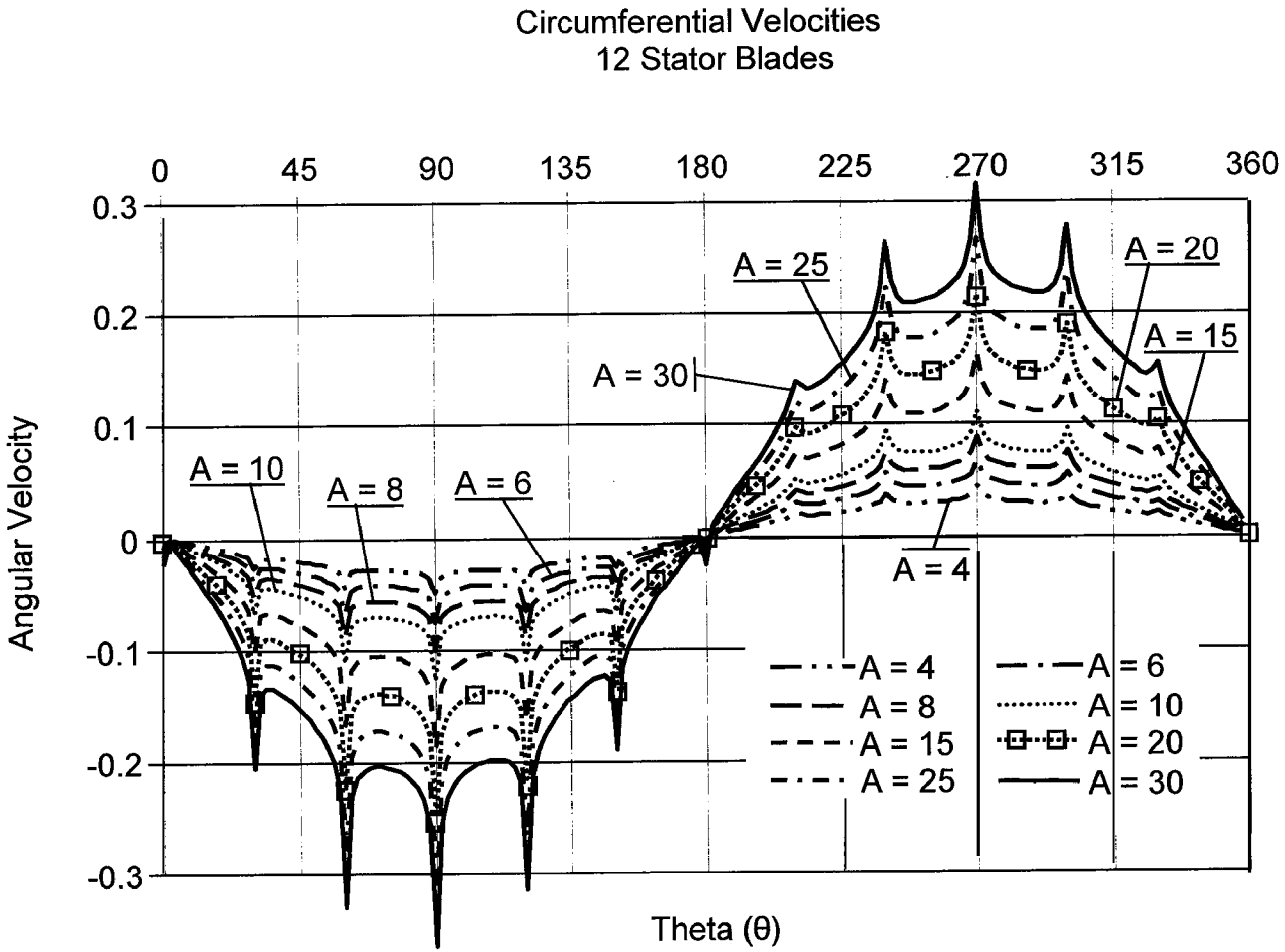

The effect of pitch amplitude, A, is evaluated (block 102) for both eight and twelve stator blades as shown in FIGS. 4A and 4B, respectively. As can be seen, the circumferential velocities increase with A. Maximum velocities vary between 0.05 for A=6° to approximately 0.2 for A=30 deg° for the eight blade configuration. Velocities increase on the order of fifteen percent for the twelve blade configuration. An artifact of the induced velocities is the spike in velocity proximal to the blade wakes. This is due to the nature of the thin vortex sheet in the wake and is not physically realistic.

Four cases are down-selected (block 106) and viscous flow fields are obtained (block 108). For the eight stator blade configuration, flow fields for pitch amplitudes of A=10° and 20° are obtained. In both cases, the axial flow is higher on one side of the vehicle than the other, which indicates the downwash due to the lift produced by the stators.

For A=20°; reverse flow velocities are noted in the stator wakes at two diametrically opposite positions. This would indicate flow separation, demonstrating that the 20° case is too extreme if flow separation is to be avoided.

Circumferential velocity distributions are also obtained. Velocities are higher for A=20° compared with 10°. Maximum and minimum velocities are biased in a manner similar to that for the axial flow.

For the twelve stator blade configuration, flow fields for pitch amplitudes of A=15° and 20° is obtained. Significant flow separation is seen for A=20°, but appears minimal for the 15° case. This suggests that A=15° is the limiting condition for this configuration. Flow stream calculations indicate that circumferential velocities approach +20% of freestream values.

As with the eight blade configuration, wake signatures are more pronounced in the twelve blade configuration. This can be attributed to the downwash produced by the individual blades that is made more evenly distributed with the twelve blade configuration. Again, velocities are found to be biased in a manner similar to that described for the eight blade configuration.

Figure 5:
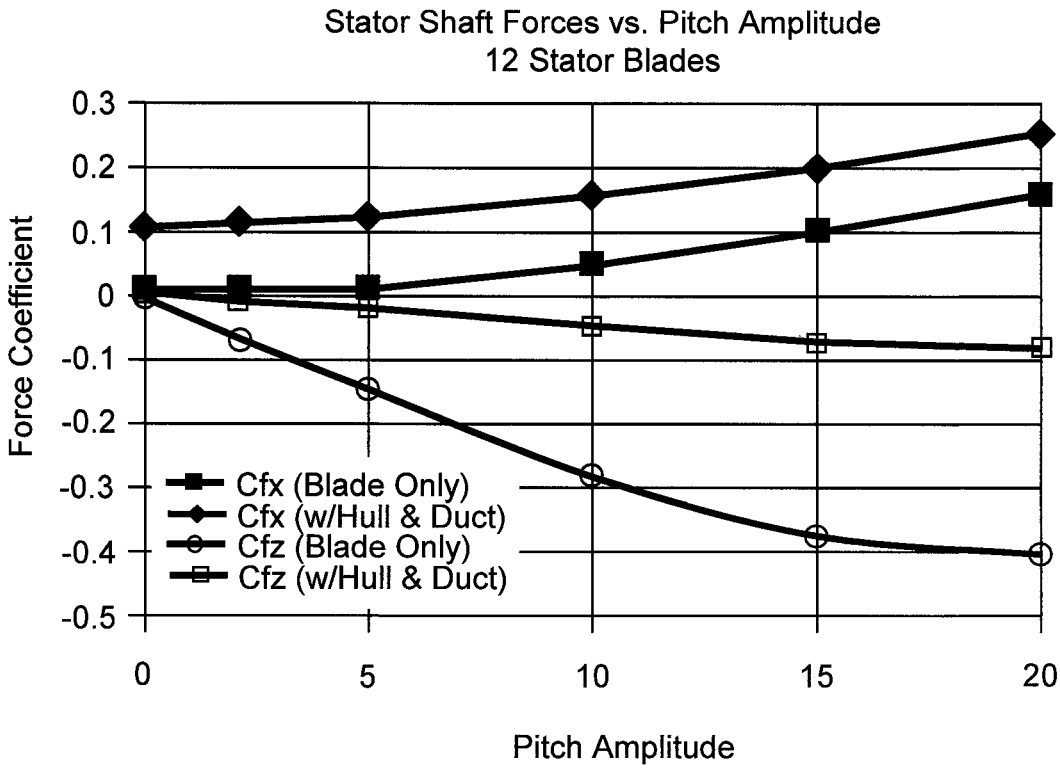
FIG. 5 is a plot of stator side force coefficients.

In addition to the flow stream, the stator side force coefficients are computed at block 108 and are plotted in FIG. 5. The force coefficient is defined as $C_f=F/(\frac{1}{2}\rho V^2\pi R_{prop}^2)$, ρ and V being density and velocity, respectively. Due to the stator configuration, the y-forces are zero with finite x-(drag) and z-forces. The plots show, that for the blade alone, the z-forces are on the order of four times larger than when the reactionary forces from the hull and duct are included (−0.4 vs. −0.072).

Combinations of the stator inflow and various rotor geometries are then analyzed (blocks 110, 112 and 114) to determine the characteristics of the unsteady rotor forces. The examined rotors include base blade configurations (no rake or skew), blades with rake and no skew, blades with skew and no rake, and blades with both rake and skew. The rotor blade itself has a constant chord length, $C_{blade}/R_{prop}$ of 0.5 that is kept constant over the span and for all blade configurations.

The total rake ($C_{xtotal}/C_{blade}$ where $c_{xtotal}$ is the blade displacement) is 1.0 with a spanwise (r) distribution computed as:

$$c_x=c_{xtotal}\sin((\pi/2)(r-r_o)/(R_{prop}-r_o)). \quad (2)$$

Here, $c_x$ is evaluated from the root radius, $r_o$, to the maximum rotor radius. The selected skew distribution ($\theta_{skew}$) has a tangential variation in the leading edge of the rotor, which can be described by:

$$\theta_{skew}=\theta_{sktotal}0.5[1.0-\cos(\pi(r-r_o)/(R_{prop}-r_o))] \quad (3)$$

Similar to the rake, the skew angle is evaluated from the root radius to the maximum rotor radius.

Figure 6A:
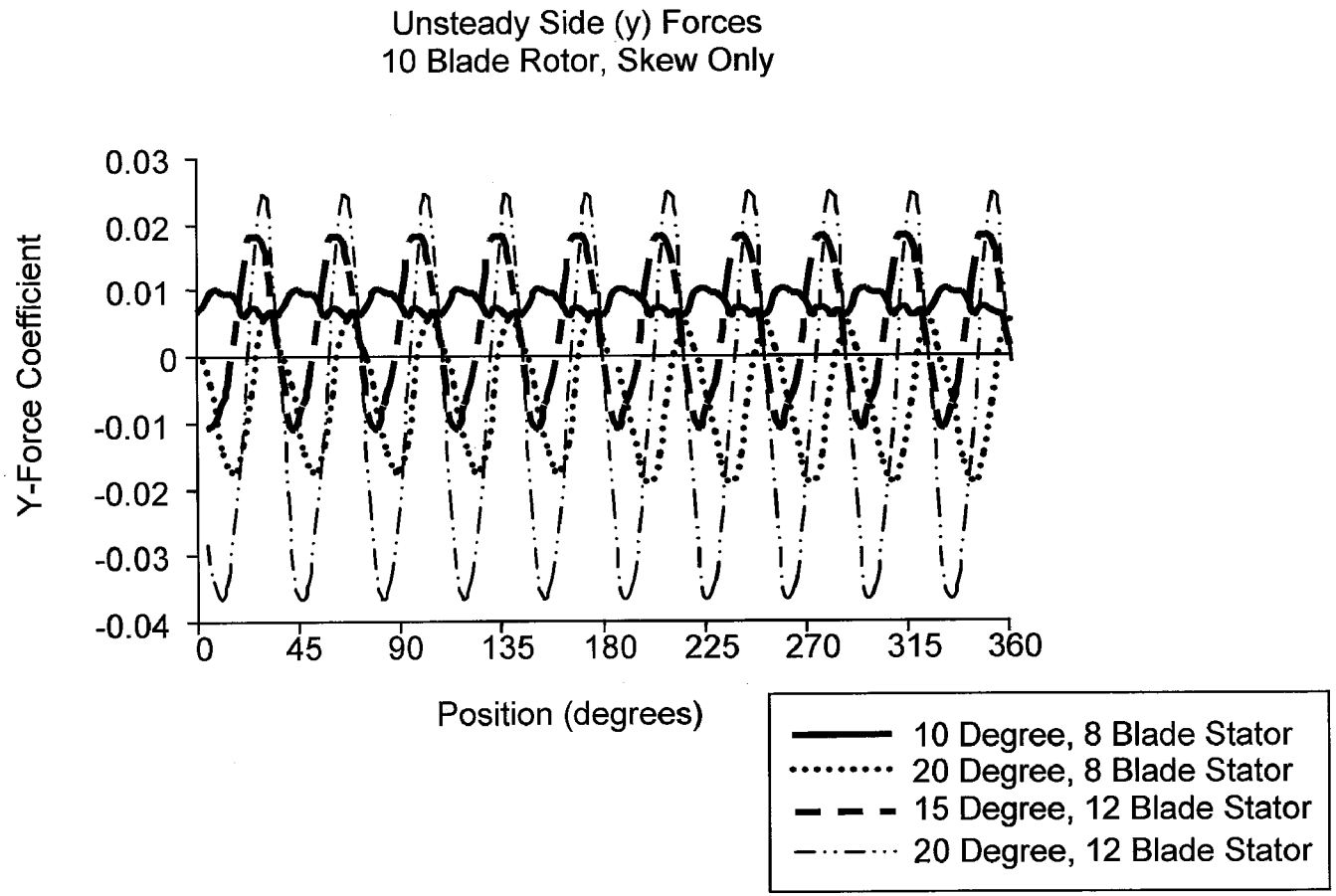
FIGS. 6A and 6B are plots of the unsteady side y- and z-force coefficients, respectively.
Figure 6B:
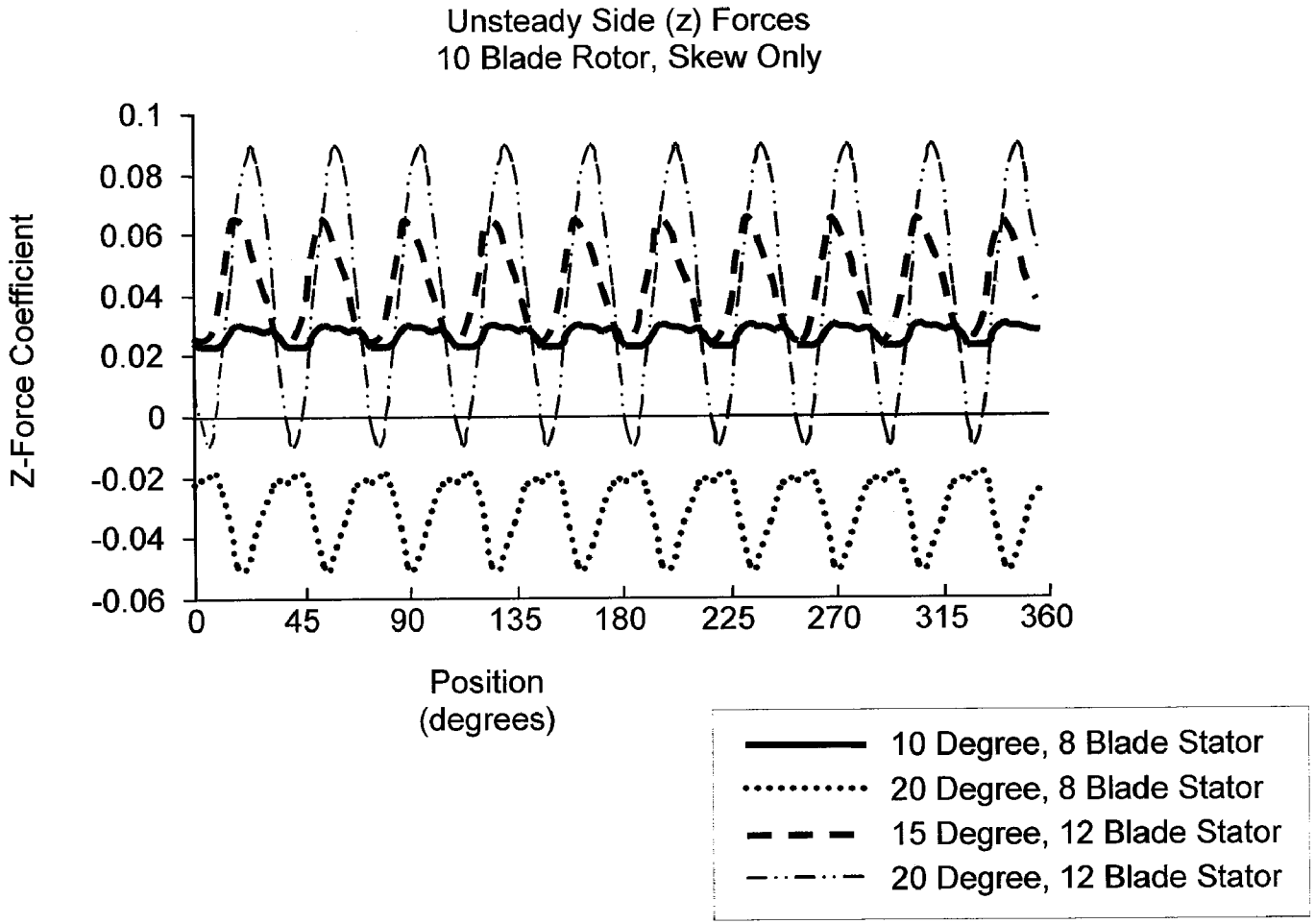

The unsteady side y- and z-force coefficients determined at block 110 are shown in FIGS. 6A and 6B, respectively, for the effect of inflow on a ten bladed skewed rotor. In these cases, unsteady forces are seen due to the difference between the individual blade wakes. The frequency identically matches the blade number giving rise to what is referred to as a blade rate effect. This effect appears largest for the twelve stator blade, A=20° configuration and smallest for the eight stator blade, A=10° case.

The mean y- and z-force coefficients for the twelve stator blade, A=15° case are 0.005 and 0.0426, respectively. For the A=10°, the eight blade case, the mean y- and z-forces are closer in magnitude (0.009 and 0.022, respectively). In both cases, the z-force is in a direction opposite that produced by the stator.

Cycling through blocks 108-114, mean y- and z-force values are determined for designs of five to ten rotor blades for a range of rake values from 0.1 to 0.5 relative to the blade chord and for skews from 5° to 45°. There is a definite effect of an even or odd blade number. This is due to the phase interaction between the stator wakes and the rotor blades as the blades pass through these wakes. Even blade numbers increase the y- and z-force magnitude with lesser relative force magnitudes for odd blade numbers.

Overall, an increase in blade number results in increased force magnitudes. An increase in rake increases they-force component and decreases the z-force component. Increasing the skew increases the y-forces so that the direction of the force changes from negative to positive. Increased skew has a negligible effect on the z-forces.

An increase in rake increases the y-force magnitude (increased force in the negative y-direction) but decreases the mean z-forces. Based on the evaluations, the maximum rotor forces are for a rotor with a skew of 30° and a rake of 0.3. Here, the z-forces are in the opposite direction as the stator forces (0.02) and the y-forces are −0.018. The magnitude of the resultant force vector is then 0.053

Figure 7A:
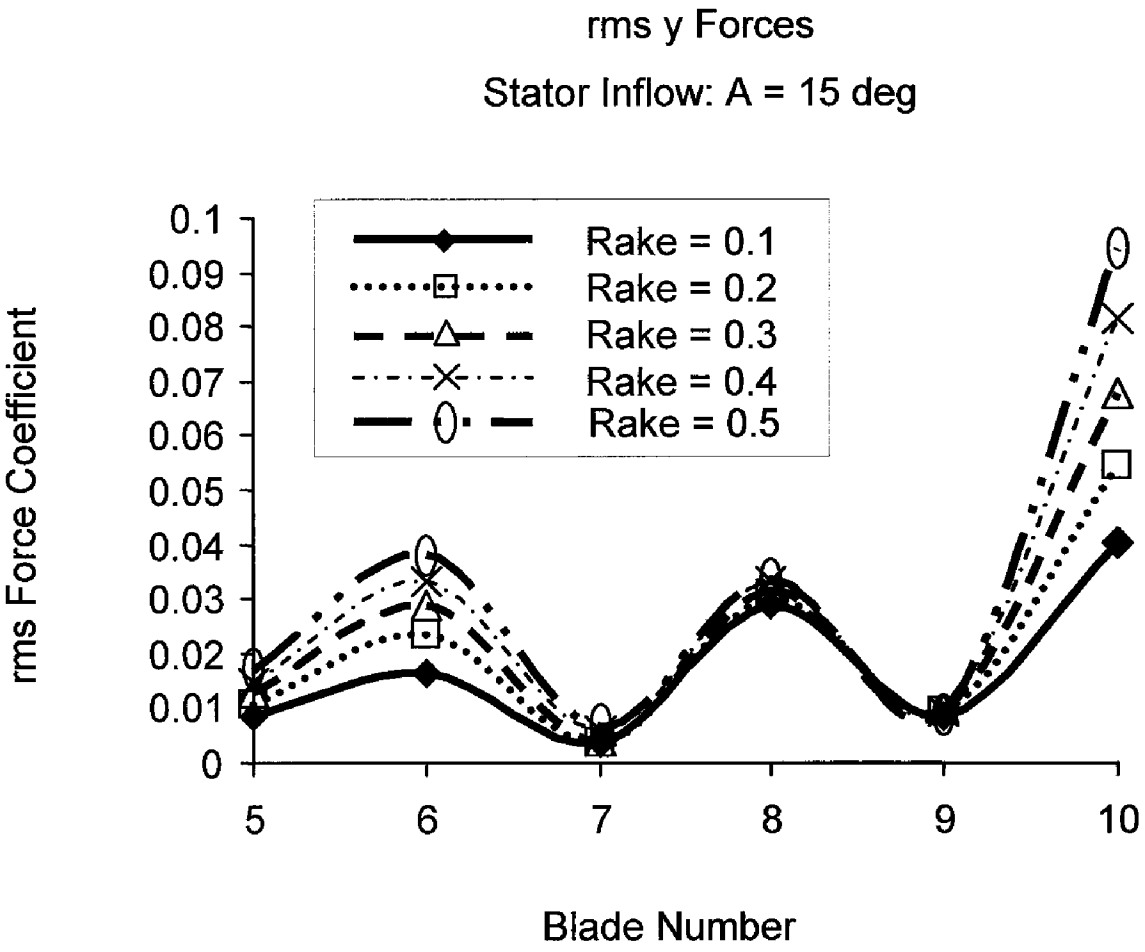
FIGS. 7A and 7B are plots of the root-mean-square y-force coefficients for a range of rotor blade rakes and a range of rotor blade skews.
Figure 7B:
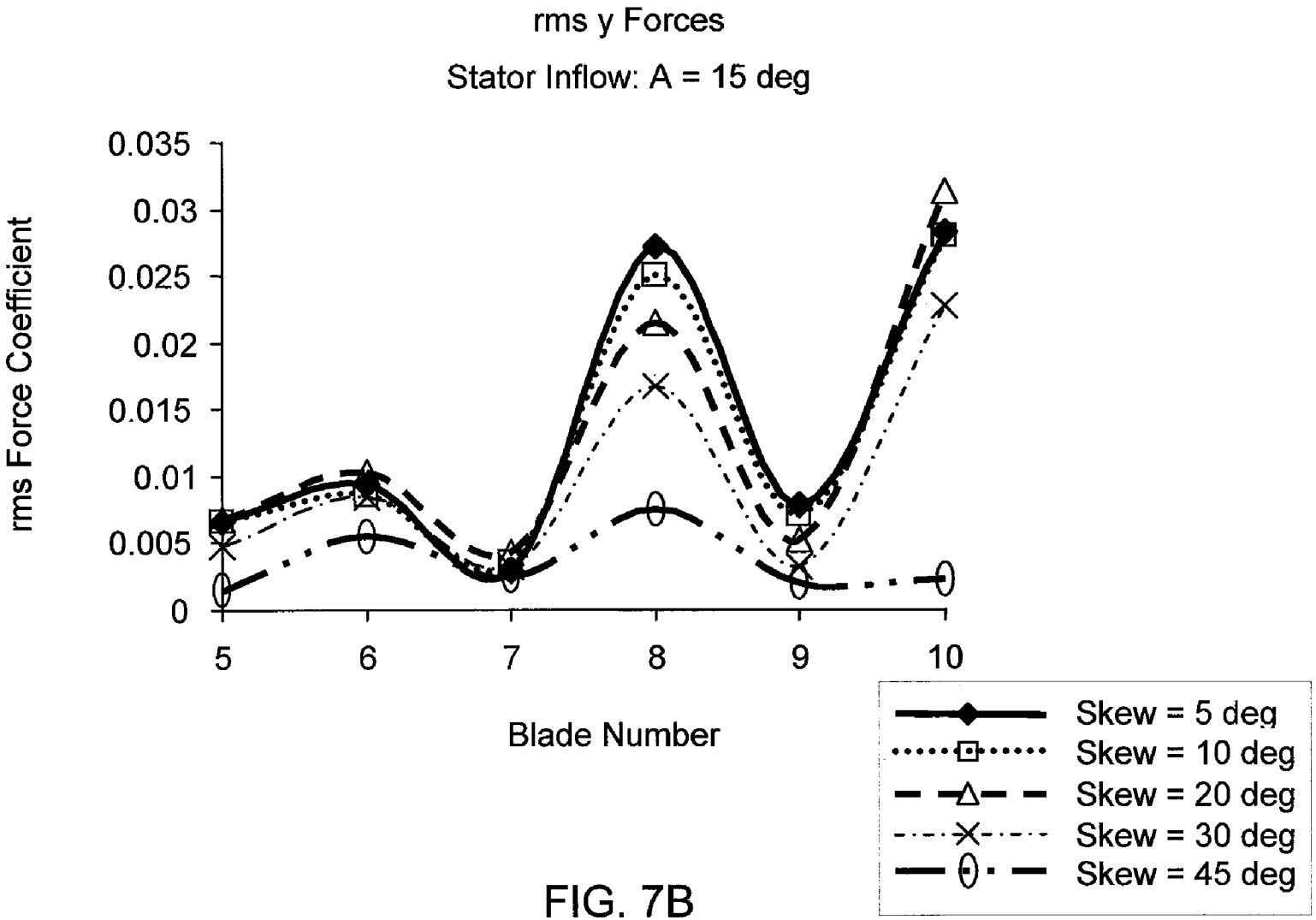

FIGS. 7A and 7B plot the root-mean-square (rms) y-force coefficients for the range of rakes (FIG. 7A) and skews (FIG. 7B) examined. The effect of even/odd blade number can be seen here; where rms forces decrease significantly with odd blade numbers. An increase in rake increases the rms forces whereas an increase in skew can significantly decrease the rms forces. Although not shown, for a nine blade rotor with a skew of 30° and a rake of 0.3, the rms y-forces are 0.004. As such, this rotor demonstrates the optimum balance between maximizing the mean forces and minimizing the rms forces and is chosen (block 116) for full evaluation (block 118).

The average stator and rotor force coefficients as computed with the results presented in Table 1. The averages presented are the forces due to the blades alone as well as inclusion of the hull and duct effects. For the stator forces, the hull and duct forces are computed on the upstream sections only and do not include the hull and duct sections used in the rotor computations. This way, the separate forces are isolated to provide a true indication of the sum forces.

TABLE 1

| Average Stator and Rotor Forces | | | | |
|---|---|---|---|---|
| | Cfy | Cfz | Cmy | Cmz |
| Stator: | | | | |
| Blades | 0.0002 | −0.2960 | 0.0268 | −0.0010 |
| With hub and duct | −0.0005 | −0.1040 | 0.0260 | −0.0001 |
| Rotor: | | | | |
| Blades | 0.0221 | 0.0493 | −0.0697 | −0.0372 |
| With hub and | 0.1025 | 0.0664 | −0.0701 | 0.0490 |
| TOTAL | 0.1020 | −0.0376 | −0.0441 | 0.0489 |

The moments are about the stator leading edge. Moment coefficients are defined as: $C_m = M/(\frac{1}{2}\rho V^2 \pi R_{prop}^3)$. As can be seen, the stators produce a force coefficient on the order of −0.296 exclusively in the z-direction. This subsequently generates a y-moment coefficient of 0.0268. The flow from the stator generates a responsive force by the hull and duct. After these effects are included, the z-force coefficients are diminished to −0.104, but the y-moment coefficient is relatively unchanged with a value of 0.0260.

Due to the rake and skew distribution, the rotor responds with forces in both the y- and z-directions with corresponding moments. There appears a substantial effect on the hull and duct forces that increase the y-force coefficient from 0.022 (blades only) to 0.1025 for the total response.

The z-forces act in a direction opposite those generated by the stator. Still, the sum forces are substantial so that the magnitude of the force coefficient vector is 0.1085 and the moment vector is 0.0658. To put this number in perspective, this translates to a force of 6.5 lbs and a moment about the stator leading edge of 12.9 ft-lbs for a 21-inch diameter vehicle traveling at three knots; thereby providing an additional fifty percent of control.

In summary, variation in upstream stator configuration and pitch amplitude greatly affects downstream flow characteristics. The twelve stator blade configuration generates a sufficiently smooth circumferential velocity variation. This number of stator blades is workable for experimental designs.

Computations focus on maintaining a zero mean blade pitch angle with maximum and minimum pitch angles at maximum and minimum y locations. The induced stator side forces are exclusively in the z-direction. Increases in pitch amplitude demonstrate increased swirl velocity variation and increased axial velocity differential from one side of the blade row to the other in response to the side force generated by the stator blade row.

The downstream rotor blade response is dependent on the blade shape parameters. An increase in rake increases the steady y-forces while decreasing the steady z-forces and increasing the unsteady forces. Increasing the skew changes the direction of the y-force, but keeps the y-force direction small while increasing the z-force and decreasing the unsteady force.

Odd blade numbers also result in smaller steady and unsteady forces. The design space study suggests that the optimal rotor configuration utilizes nine blades with a 30° skew and a rake of 0.3. This particular case uses RANS with the twelve blade, 10° pitch amplitude stator configuration. Significant side forces are computed with force coefficient magnitude of 0.1085 and a moment coefficient about the stator leading edge of 0.066.

What has thus been described is a propulsor system that generates side forces and a methodology for designing the propulsor system. The system utilizes a pre-swirl propulsor configuration with the upstream stator blades situated at varying pitch angles to generate a circumferentially varying inflow. This variation in stator blade pitch also results in side force generation by the stator blade row and also introduces an effective downwash that is ingested into the downstream rotor. The rotor then produces a side force whose magnitude and direction are dependent on the rotor blade number and the rake and skew parameters of the rotor blades.

The methodology for design of the propulsor includes performing computations to characterize the stator-induced flow for a variation in blade pitch angles. The stator inflow is used as velocity boundary conditions to examine the design variables including rotor blade number, skew, rake and combinations thereof. Steady and unsteady forces are computed to optimize the blade design in terms of maximum mean forces and minimum unsteady forces.

Obviously many modifications and variations of the present invention may become apparent in light of the above teachings. For example, the design of the stator blades and the number of stator blades in the propulsor system described herein can be varied. Also, the pitch of the stator blades can be varied in any number of ways, provided that the pitch variance produces the side forces and circumferentially varying flow described herein. Further, the design of the rotor blades, including rotor blade number and the rake and skew parameters can be varied.

In addition, the steps of the method need not be performed in the particular order described herein. The cycling through the stator design evaluations (block 104 for block 102), the flow field computations (blocks 110-114 for block 108) and the rotor force computations (block 112 for block 110) can be performed in a different order.

As an example, the flow field computations (block 108) for each downselected design can be performed prior to obtaining the rotor forces (block 110). As a still further example, though not computationally efficient, the stator design evaluation (block 102), the flow field computation (block 108) and the rotor force computation (block 110) can be performed without cycling.

In light of the above, it is therefore understood that within the scope of the appended claims, the invention may be practiced otherwise than as specifically described.

What is claimed is:

1. A method for designing a ducted, pre-swirl propulsor for an underwater vehicle to produce maneuvering forces, said method comprising the steps of:

characterizing stator forces and a stator-induced flow for a variation in stator blade pitch angles;

computing rotor forces based on the induced flow; and choosing rotor blade parameters to optimize the rotor forces, a combination of the stator forces and the rotor forces producing the maneuvering forces.

2. A method according to claim 1, wherein said characterizing step comprises the step of varying said stator blade pitch angles symmetrically about a circumference of the underwater vehicle.

3. A method according to claim 2, wherein said varying step comprises the step of sinusoidally varying the pitch angles dependent on an angular position of stator blades about the circumference.

4. A method according to claim 1, wherein said characterizing step comprises the steps of recursively characterizing a plurality of flows based on at least one of incrementing a number of stator blades and incremental changes in the variation in stator blade pitch angles.

5. A method according to claim 4, said method further comprising the step of selecting at least one of the plurality of flows as the induced flow.

6. A method according to claim 5, wherein said computing rotor forces step comprises the steps of recursively computing a plurality of forces based on at least one of incrementing a number of rotor blades, incremental changes in rotor blade skew and incremental changes in rotor blade rake.

7. A method according to claim 6, wherein said computing rotor forces step comprises the step of recursively computing the plurality of forces based on the plurality of flows.

8. A method according to claim 7, wherein said choosing rotor blade parameters step comprises selecting at least one combination of the number of rotor blades, the rotor blade skew and the rotor blade rake.

9. A method according to claim 1, wherein said choosing rotor blade parameters step is based on maximizing mean rotor forces and minimizing unsteady rotor forces.

10. A ducted, pre-swirl propulsor system for an underwater vehicle, said system comprising:

a row of stator blades, a pitch angle, $\alpha_{blade}$, of said stator blades varying about a circumference of the vehicle to produce a circumferentially varying downflow; and a rotor ingesting the downflow to produce a side force on the vehicle.

11. A system according to claim 10, wherein the pitch angle varies symmetrically about the circumference.

12. A system according to claim 11, wherein the pitch angle varies according to a sinusoidal function.

13. A system according to claim 12, wherein the function is of the form $\alpha_{blade}=\alpha_{mean}+A \sin \theta$, wherein:

$\alpha_{mean}$ is a mean angle of attack of said stator blades;

A is a pitch amplitude parameter; and $\theta$ is an angular position of a one of said stator blades about the circumference.

14. A system according to claim 13, wherein the mean angle of attack is 0°.

15. A system according to claim 14, wherein said stator blades have a symmetrical blade cross section.

16. A system according to claim 15, wherein:

said row of stator blades comprises an even number of stator blades; and said rotor comprises an odd number of rotor blades.

17. A system according to claim 10, wherein:

said row of stator blades comprises an even number of stator blades; and said rotor comprises an odd number of rotor blades.

18. A system according to claim 17, wherein the pitch angle varies symmetrically about the circumference.

19. A system according to claim 18, wherein said stator blades have a symmetrical blade cross section.

* * * * *